US010543997B2

(12) United States Patent
Sawashima et al.

(10) Patent No.: US 10,543,997 B2
(45) Date of Patent: Jan. 28, 2020

(54) SHEET FEEDING APPARATUS AND IMAGE FORMING APPARATUS

(71) Applicant: CANON KABUSHIKI KAISHA, Tokyo (JP)

(72) Inventors: Fumiya Sawashima, Tokyo (JP); Tetsuji Suzuki, Fujisawa (JP); Ryuji Hamasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/052,767

(22) Filed: Aug. 2, 2018

(65) Prior Publication Data

US 2019/0062087 A1 Feb. 28, 2019

(30) Foreign Application Priority Data

Aug. 22, 2017 (JP) ..... 2017-159735
Aug. 22, 2017 (JP) ..... 2017-159736
Nov. 30, 2017 (JP) ..... 2017-230515

(51) Int. Cl.
*B65H 3/56* (2006.01)
*B65H 3/06* (2006.01)
*B65H 5/06* (2006.01)

(52) U.S. Cl.
CPC ..... *B65H 3/565* (2013.01); *B65H 3/0669* (2013.01); *B65H 3/0684* (2013.01); *B65H 5/062* (2013.01); *B65H 2403/512* (2013.01); *B65H 2403/533* (2013.01); *B65H 2404/1341* (2013.01)

(58) Field of Classification Search
CPC ..... B65H 3/0684; B65H 3/0669; B65H 2404/1341; B65H 2403/533; B65H 2403/512; B56H 3/565
See application file for complete search history.

(56) References Cited

U.S. PATENT DOCUMENTS 5,370,380 A 12/1994 Suzuki et al.
5,580,042 A 12/1996 Taniguro et al.
5,648,808 A 7/1997 Yanagi et al.
(Continued)

FOREIGN PATENT DOCUMENTS

JP H03-088648 A 4/1991
JP H06-144624 A 5/1994
(Continued)

OTHER PUBLICATIONS

European Search Report dated Jan. 21, 2019, in related European Patent Application No. 18187554.3.
(Continued)

*Primary Examiner* — Patrick Cicchino
(74) *Attorney, Agent, or Firm* — Venable LLP

(57) ABSTRACT

A sheet feeding apparatus includes an abutment part having an abutment area against which a leading edge of a sheet abuts and a moving part to move the abutment part between first and second positions. The moving part includes a link member having an engage portion to engage with a positioning portion, the link member being joined with the abutment part, and an urging member to urge the link member such that the abutment part moves toward the second position. The abutment part is retained at the first position against an urging force of the urging member in a case where the positioning portion is engaged with the engage portion of the link member.

16 Claims, 11 Drawing Sheets

(56) References Cited

U.S. PATENT DOCUMENTS

| | | | | |
|---|---|---|---|---|
| 6,168,270 | B1 | 1/2001 | Saikawa et al. | |
| 6,877,738 | B2 * | 4/2005 | Sonoda | B65H 3/0607 271/121 |
| 7,665,725 | B2 * | 2/2010 | Bridges | B65H 1/04 271/121 |
| 7,967,287 | B2 | 6/2011 | Hamasaki et al. | |
| 8,465,016 | B2 * | 6/2013 | Winburne | B65H 3/0661 271/117 |
| 8,891,143 | B2 * | 11/2014 | Omori | B65H 3/0669 358/474 |
| 9,010,748 | B2 | 4/2015 | Hamasaki | |
| 9,102,486 | B2 * | 8/2015 | Yoshitsugu | B65H 31/08 |
| 2002/0175462 | A1 * | 11/2002 | Sonoda | B65H 3/0607 271/121 |
| 2010/0133743 | A1 | 6/2010 | Hamasaki et al. | |
| 2011/0221121 | A1 | 9/2011 | Hamasaki et al. | |
| 2013/0001859 | A1 | 1/2013 | Sugiyama et al. | |
| 2013/0120810 | A1 * | 5/2013 | Omori | B65H 3/0669 358/498 |
| 2018/0222224 | A1 * | 8/2018 | Jariabka | B65H 3/06 |
| 2018/0346267 | A1 * | 12/2018 | Kanemaru | B65H 3/0638 |

FOREIGN PATENT DOCUMENTS

| | | | |
|---|---|---|---|
| JP | 2016-052950 | A | 4/2016 |
| WO | 2012017624 | A1 | 2/2012 |

OTHER PUBLICATIONS

Daigo Yamauchi et al., U.S. Appl. No. 15/982,267, filed May 17, 2018.

* cited by examiner

SHEET FEEDING APPARATUS AND IMAGE FORMING APPARATUS

BACKGROUND OF THE INVENTION

Field of the Invention

The present invention relates to a sheet feeding apparatus for feeding sheets and an image forming apparatus including the sheet feeding apparatus.

Description of the Related Art

Conventionally, a sheet feeding apparatus including a sloping-surface member has been proposed, as described in Japanese Patent Application Publication No. 2016-052950. The sloping-surface member separates a sheet, one by one, from sheets fed by a sheet feeding roller. The sloping-surface member has a sloping surface which is obtuse with respect to a sheet feeding tray on which sheets are stacked. Sheets fed by the sheet feeding roller are separated into one sheet from the other while passing the sloping surface. The sloping-surface member has an opening, from which an abutment member protrudes. When sheets are inserted into the sheet feeding tray, the leading edge of the sheets abuts against the abutment member positioned at a protruding position. Thus, the sheets are set at a proper set position.

The abutment member is urged by a spring member toward a retracting position. The retracting position is a position to which the abutment member is retracted from the sloping surface. When the abutment member is pushed by a cam member against the urging force of the spring member, the abutment member is positioned at the protruding position. The cam member is driven by a motor. That is, the abutment member can be moved to the protruding position or the retracting position by the motor that drives the cam member in a forward direction or a reverse direction.

The sheet feeding apparatus described in Japanese Patent Application Publication No. 2016-052950 controls the cam member, in a job to continuously form an image on a plurality of sheets, so that the abutment member is positioned at the retracting position at the beginning of the job, and at the protruding position at the end of the job. However, when a sheet is leaning on the sloping surface during the job, the sheet feeding apparatus fails to push back the sheet, and may cause failure of the feeding.

SUMMARY OF THE INVENTION

According to one aspect of the present invention, a sheet feeding apparatus includes a stacking part on which a sheet is stacked, a feeding part configured to feed the sheet stacked on the stacking part, a separation part configured to separate the sheet from another sheet while slidingly contacting the sheet fed by the feeding part, an abutment part comprising an abutment area against which a leading edge of the sheet stacked on the stacking part abuts, the abutment part being configured to move between a first position and a second position, the first position being a position at which at least a part of the abutment area protrudes from the separation part toward the feeding part, the second position being a position at which the abutment area does not protrude from the separation part toward the feeding part, a transmission part comprising a rotary member and configured to transmit driving power from a driving source to the feeding part via the rotary member, the rotary member being configured to be stopped every one rotation, and a moving part configured to move the abutment part in response to rotation of the rotary member such that (1) the abutment part positions at the first position in a case where the rotary member is stopped, and (2) the abutment part moves from the first position to the second position and from the second position to the first position while the rotary member makes one rotation.

Further features of the present invention will become apparent from the following description of exemplary embodiments with reference to the attached drawings.

DESCRIPTION OF THE EMBODIMENTS

Overall Configuration

Figure 1:
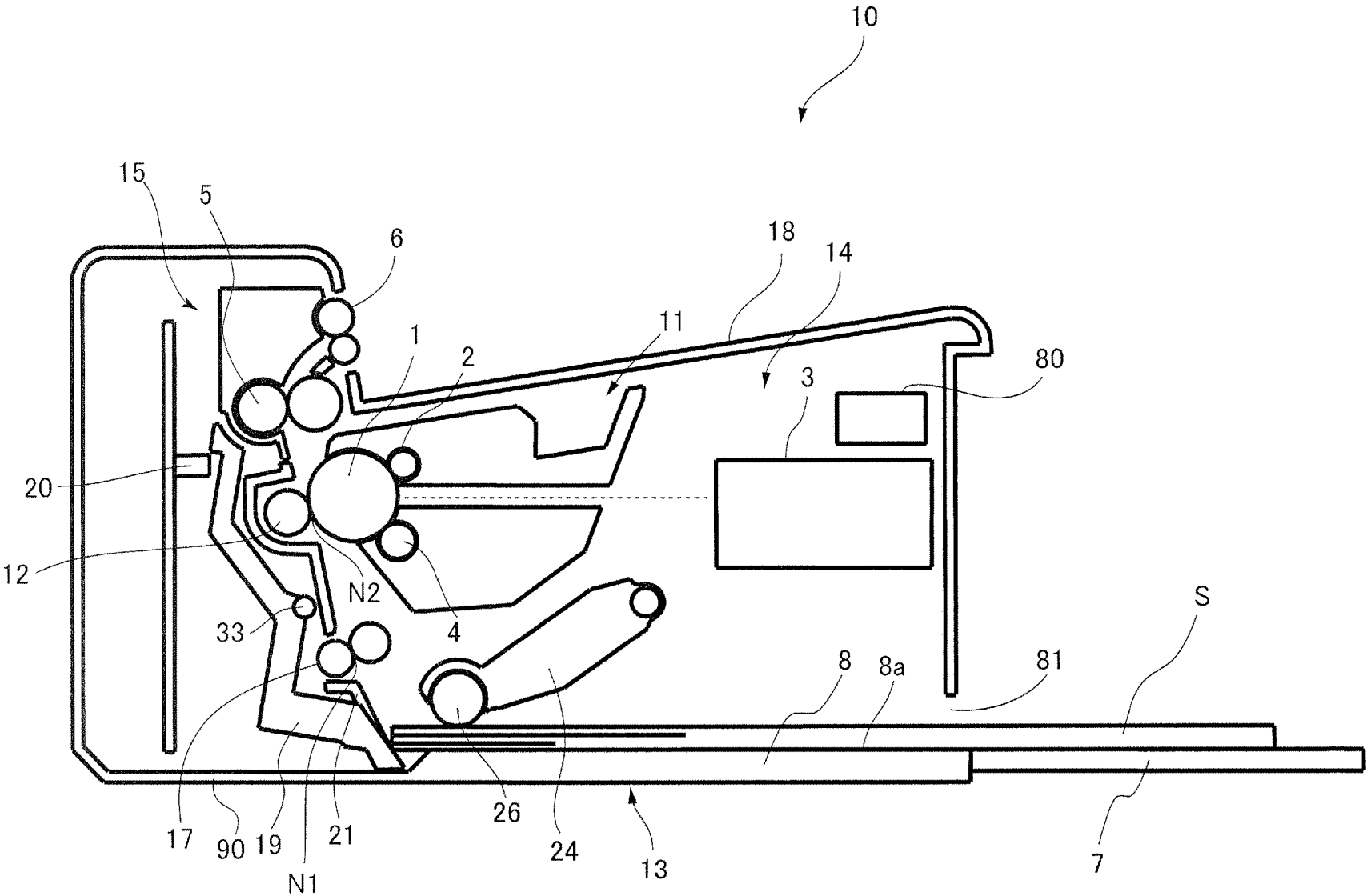
FIG. 1 is an overall schematic view illustrating a printer.

Hereinafter, an embodiment will be described. A printer 10, which serves as an image forming apparatus, is an electrophotographic monochrome laser-beam printer. As illustrated in FIG. 1, the printer 10 includes an image forming portion 14, serving as an image forming part, to form an image on a sheet S, a sheet feeding apparatus 13, a fixing portion 15, and a discharge roller pair 6.

The sheet feeding apparatus 13 includes a controller 80 that controls each component of the printer 10, which includes the sheet feeding apparatus 13. The printer 10 forms an image on the sheet S, fed by the sheet feeding apparatus 13, under the control of the controller 80 and depending on image information data sent from an external device, such as a computer. In the present embodiment, the controller 80 is disposed on a control board used to control the printer 10. Alternatively, the sheet feeding apparatus 13 may be achieved as a unit, the controller 80 may be disposed in the unit that serves as the sheet feeding apparatus 13, and the controller 80 may be electrically connected with a controller of the printer 10.

The image forming portion 14 includes a detachable process cartridge 11, an exposure apparatus 3, and a transfer roller 12. The process cartridge 11 includes a photosensitive drum 1, a charging roller 2, and a developing roller 4. The photosensitive drum 1 includes a cylindrical member and a photosensitive layer formed on the surface of the cylindrical member, and can be rotated by a motor (not illustrated). The charging roller 2 uses an applied charging voltage, and causes the surface of the photosensitive drum 1 to be electrically charged with an identical electric potential. The exposure apparatus 3 scans the photosensitive drum 1 by using a laser beam, and forms an electrostatic latent image on the surface of the photosensitive drum 1. The developing roller 4 carries toner, and supplies the toner to the photosensitive drum 1 to develop the electrostatic latent image formed on the photosensitive drum 1, as a toner image.

While the image forming process is performed by the image forming portion 14, the sheet S is conveyed from the sheet feeding apparatus 13 to a nip N1 of a conveyance roller pair 17. The sheet S is then conveyed by the conveyance roller pair 17 toward a transfer nip N2, which is formed by the photosensitive drum 1 and the transfer roller 12. Here, a registration roller pair may be disposed between the conveyance roller pair 17 and the transfer nip N2, and may convey the sheet S to the transfer nip N2 in synchronization with a timing of the transfer performed at the transfer nip N2.

The toner image on the photosensitive drum 1 is transferred onto the sheet S at the transfer nip N2, by the transfer roller 12 being applied with a bias voltage. Here, sticking substance such as remaining toner, which has not been transferred onto the sheet S and is left on the photosensitive drum 1, is removed by a cleaner (not illustrated). The sheet S on which the unfixed image is formed is then heated while pressurized, by a fixing roller pair 5 of the fixing portion 15. With this operation, the toner image which has been transferred onto the sheet S melts, solidifies, and adheres to the sheet S. The sheet S to which the image has been fixed by the fixing portion 15 is then discharged to a discharge tray 18 by the discharge roller pair 6, and the print operation completes.

Sheet Feeding Apparatus

As illustrated in FIG. 1, the sheet feeding apparatus 13 includes a feeding tray 8, which serves as a stacking part. The feeding tray 8 includes a stacking surface 8*a*, serving as a support surface, on which the sheet S is stacked. The feeding tray 8 is provided with an auxiliary tray 7, which can be pulled out. The position of the sheet S stacked on the stacking surface 8*a* is regulated by a pair of side regulation plates (not illustrated), in a width direction which is orthogonal to a sheet feeding direction. A front face of the printer 10 (on which the operation is performed) is arranged on the right side in FIG. 1, and is provided with an insertion opening 81, which is used to insert the sheet S into the sheet feeding apparatus 13. The feeding tray 8 may be integrally formed with an exterior cover 90, which serves as an exterior member to constitute the exterior of the sheet feeding apparatus 13 and the printer 10; or may be formed separately from the exterior cover 90.

A conveyance guide 21 is disposed in the downstream of the feeding tray 8 in the sheet feeding direction. The conveyance guide 21 supports a flag member 19 which can pivot on a pivot shaft 33. In a state where the sheet S is not inserted into the feeding tray 8, the flag member 19 protrudes from the conveyance guide 21 toward the front side of the printer 10 (right side in FIG. 1). When a user inserts the sheet S into the feeding tray 8, the flag member 19 is pressed by the leading edge of the sheet S, and pivots. When the flag member 19 pivots, light to a photo sensor 20 is blocked, and thus the controller 80 can detect the sheet S stacked on the feeding tray 8.

Figure 2:
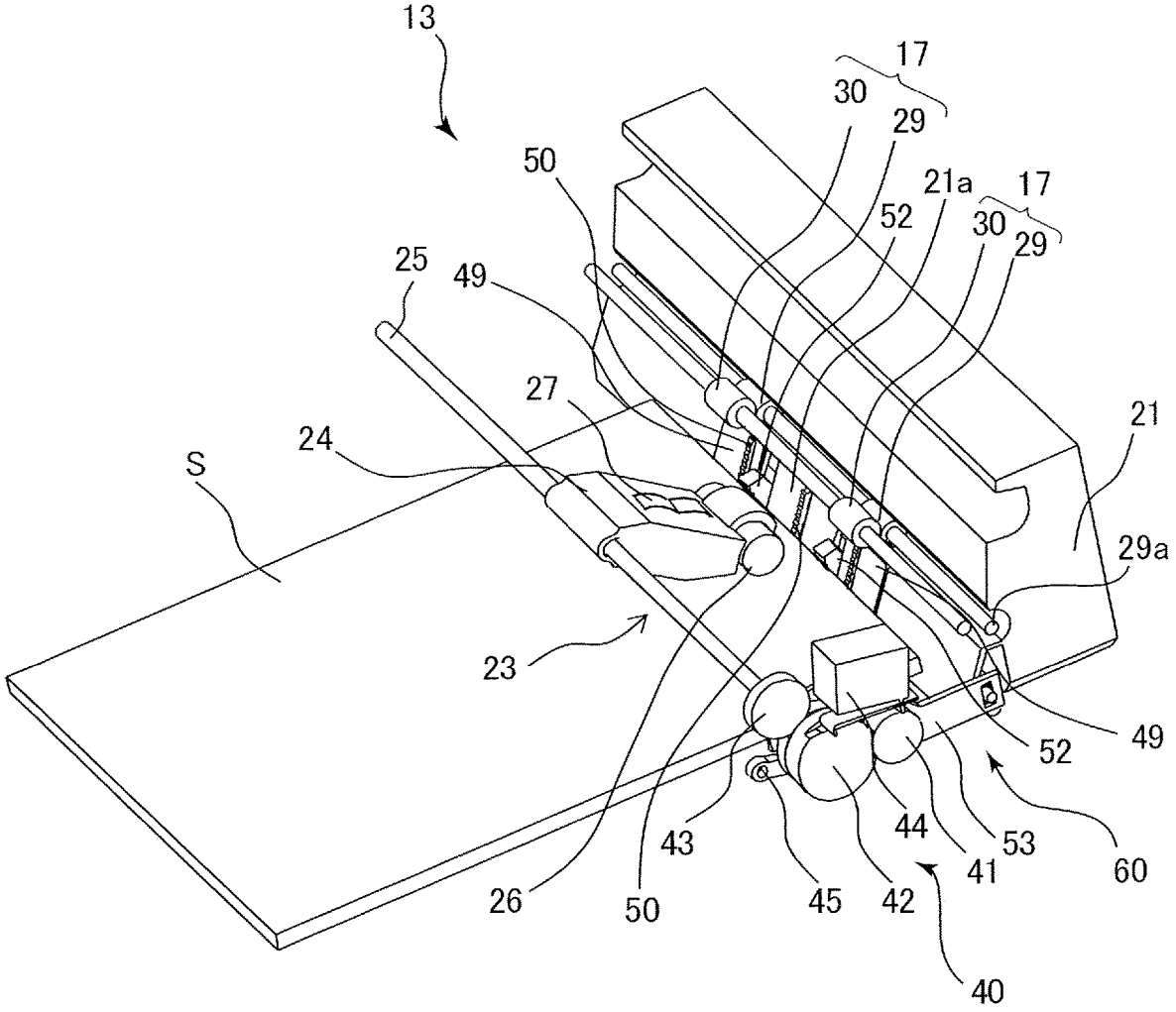
FIG. 2 is a perspective view illustrating a sheet feeding apparatus.
Figure 3:
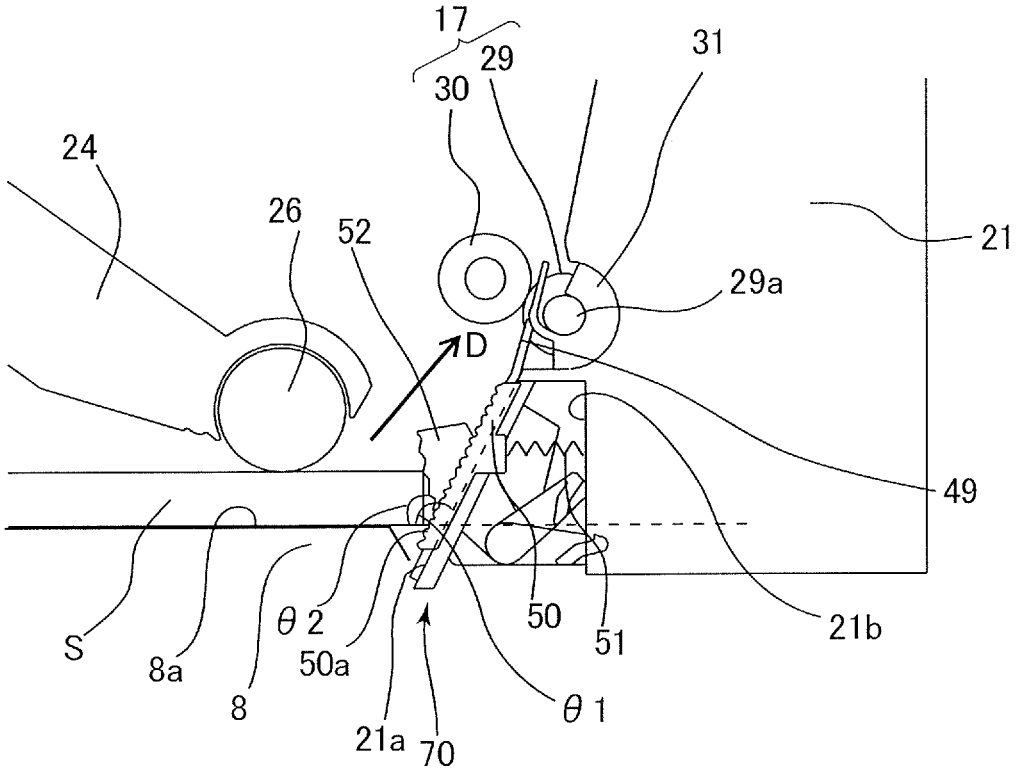
FIG. 3 is a sectional view illustrating the sheet feeding apparatus.
Figure 4A:
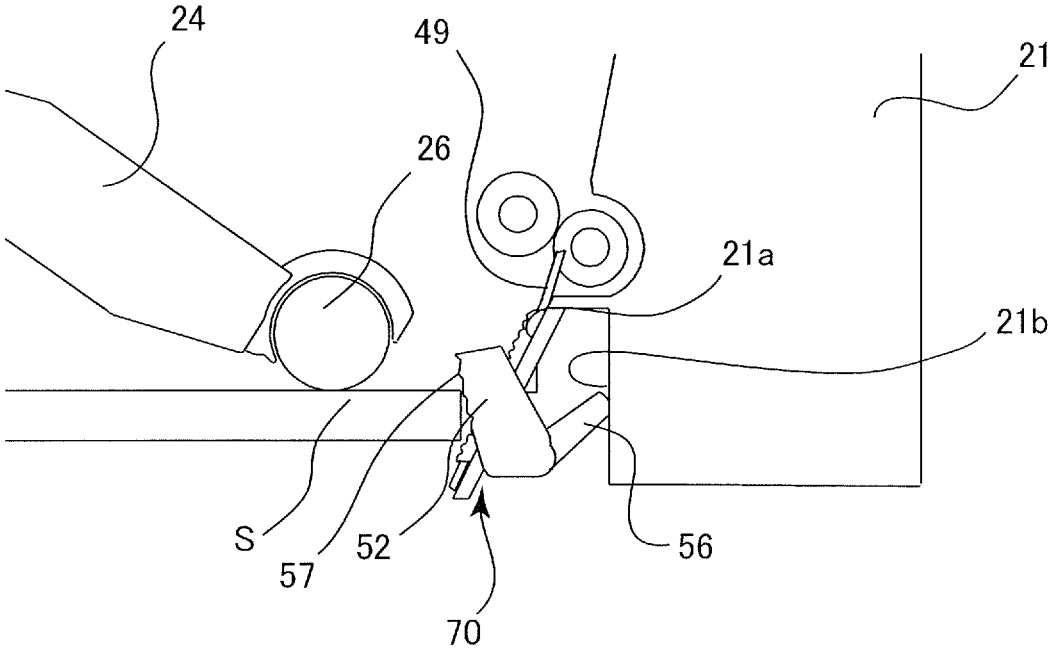
FIG. 4A is a sectional view illustrating an abutment member positioned at a protruding position.
Figure 4B:
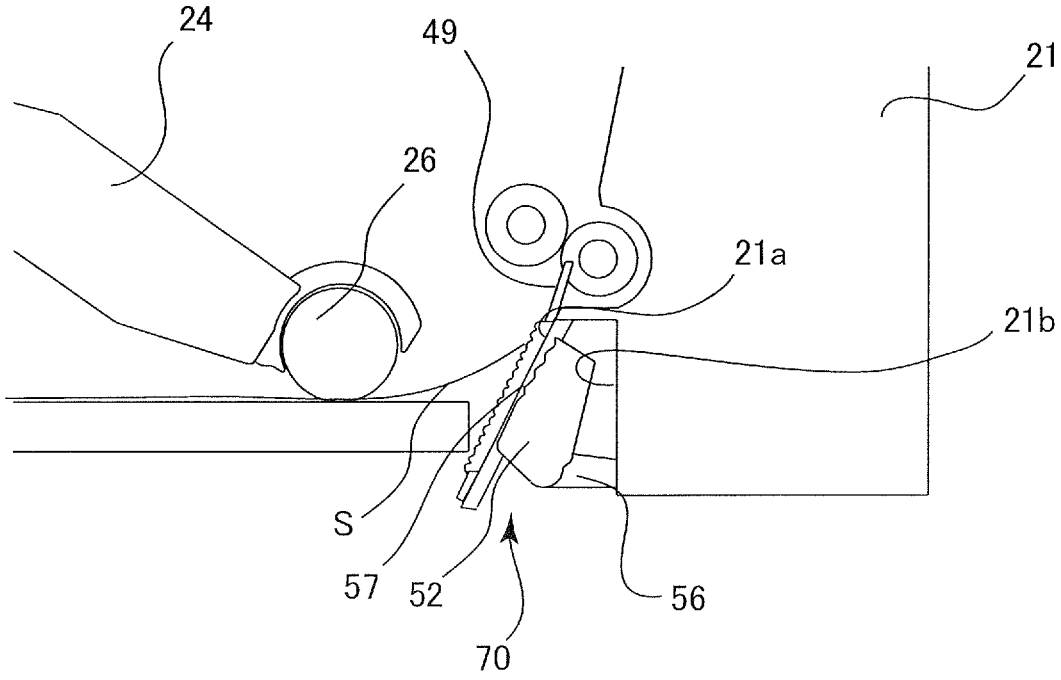
FIG. 4B is a sectional view illustrating the abutment member positioned at a retracting position.

FIG. 2 is a perspective view illustrating the sheet feeding apparatus 13. FIGS. 3, 4A, and 4B are sectional views illustrating the sheet feeding apparatus 13. In FIGS. 2 to 4B, the flag member 19 is not illustrated. As illustrated in FIG. 2, the sheet feeding apparatus 13 includes a feeding mechanism 23, a transmission mechanism 40, and a moving mechanism 60. The transmission mechanism 40 serves as a transmission part; and transmits driving force of a motor M, which serves as a driving source, to the feeding mechanism 23. The moving mechanism 60 serves as a moving part, and moves later-described abutment members 52.

The feeding mechanism 23 includes a rotation shaft 25, a holder 24 which is swingably supported by the rotation shaft 25, and a pickup roller 26 which serves as a feeding part and is rotatably supported by the end of the holder 24. The holder 24 includes a drivetrain 27 disposed between the rotation shaft 25 and the pickup roller 26. The drivetrain 27 is constituted by gears. The rotation of the rotation shaft 25 is transmitted to the pickup roller 26 via the drivetrain 27. The holder 24 can swing in accordance with the height of sheets stacked on the stacking surface 8*a* (see FIG. 1) of the feeding tray 8. When the pickup roller 26 rotates in a state where the pickup roller 26 abuts against the uppermost sheet S, the sheet S is conveyed toward the conveyance guide 21.

As illustrated in FIG. 3, the conveyance guide 21, which serves as a guide part, has a sloping surface 21*a*. The angle θ1 of the sloping surface 21*a* with respect to the stacking surface 8*a* of the feeding tray 8 is obtuse on the pickup roller side. The sloping surface 21*a* which serves as a separation part and a separation surface is provided with a sloping-surface cover 49. The sloping-surface cover 49 has its low resistance to the conveyance, and thus smoothly guides the sheet S to the conveyance roller pair 17. The conveyance guide 21 supports separation members 50. The separation members 50 are urged by separation springs 51 such that the separation members 50 protrude from the sloping surface 21*a* and the sloping-surface cover 49 toward the pickup roller 26. The separation members 50 and the separation springs 51 are each provided in threes to be symmetric to each other. Here, a center of the conveyance path in the width direction serves as a center of the symmetry. The separation members 50, the sloping-surface cover 49, and the conveyance guide 21 constitute a separation sloping-surface portion 70.

On a surface 50*a* of each of the separation members 50, a plurality of convexities and concavities are formed along the sloping surface 21*a*. The separation members 50 can move between a protruding position and a retracting position. When the separation members 50 are positioned at the protruding position, the separation members 50 protrude from the sloping surface 21*a* and the sloping-surface cover 49 toward the pickup roller 26. When the separation members 50 are positioned at the retracting position, the separation members 50 are retracted in the inside of the sloping surface 21*a*. When the sheet S is fed by the pickup roller 26, the separation members 50 are moved from the protruding position to the retracting position against the urging force of the separation springs 51. In this time, the sheet S can be effectively separated from another sheet because the convexities and concavities are formed on the surface 50*a* of each of the separation members 50.

The conveyance roller pair 17 is disposed in the downstream of the separation members 50 in a sheet traveling direction D. The conveyance roller pair 17 has a driving roller 29 and a driven roller 30. The driven roller 30 is urged toward the driving roller 29 by a spring (not illustrated), with a predetermined pressure. A rotation shaft 29*a* of the driving roller 29 is rotatably supported by a bearing 31 which is fit in the conveyance guide 21.

Abutment Members

Figure 5:
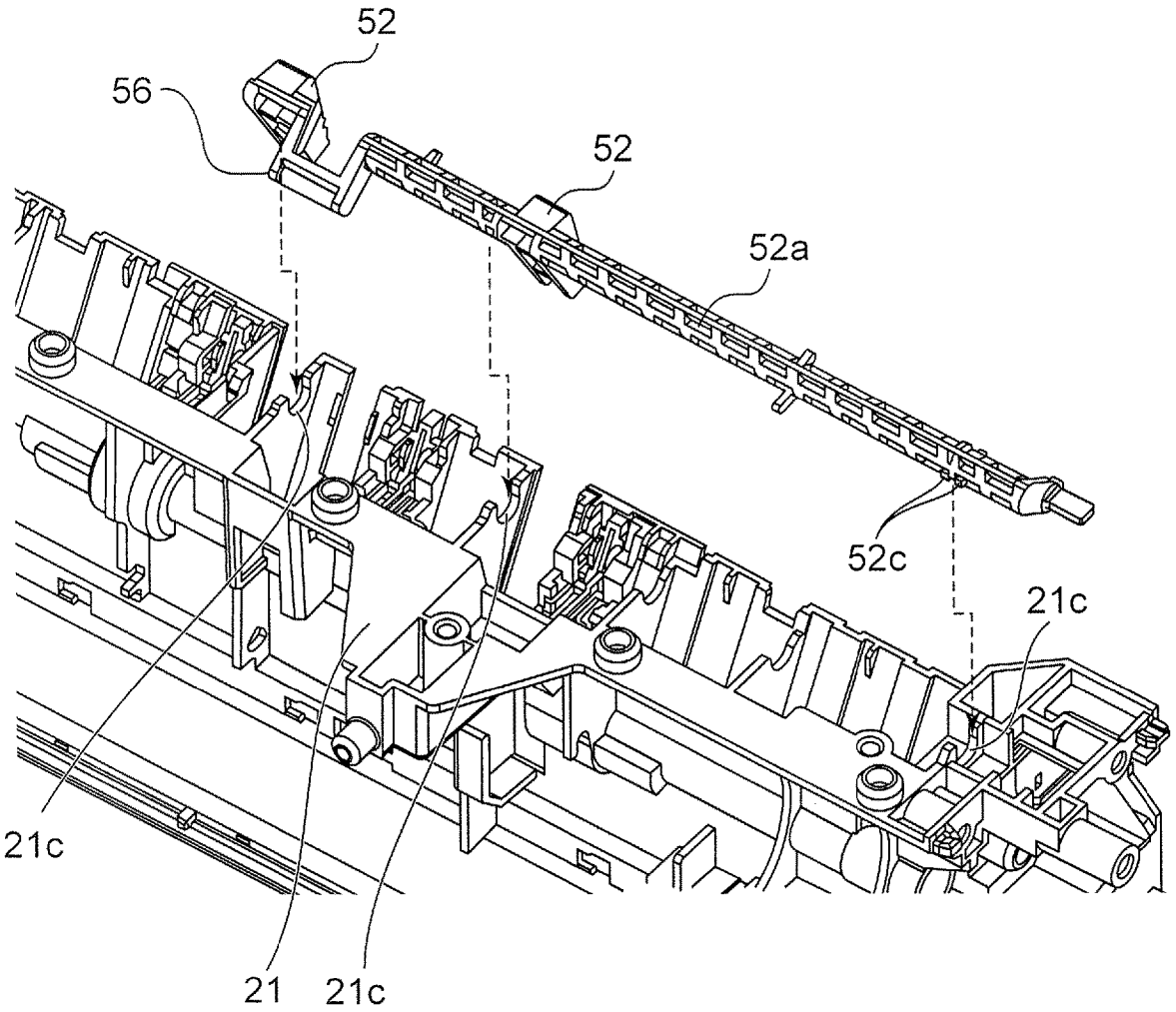
FIG. 5 is an exploded perspective view of a conveyance guide and a pivot shaft as viewed from a bottom face side of the printer.

As illustrated in FIGS. 2 and 3, the sloping surface 21*a* is provided with openings 21*b* serving as an opening part, which accommodate respective abutment members 52 serving as an abutment part. The openings 21*b* and the abutment members 52 are each provided in twos to be symmetric to each other. Here, a center of the conveyance path in the width direction serves as a center of the symmetry. As illustrated in FIG. 5, the right and left abutment members 52 are formed on a pivot shaft 52*a*, which serves as a shaft member. Between the right and left abutment members 52, there is formed a stopper 56 which is bent in a U shape.

The abutment members 52 can pivot between a protruding position illustrated in FIG. 4A and a retracting position illustrated in FIG. 4B, with the rotation of the pivot shaft 52*a*. When the stopper 56 abuts against the conveyance guide 21 or a frame other than the conveyance guide 21, the abutment members 52 are restricted at the retracting position from moving. The abutment members 52 each have an abutment surface 57 which can abut against the leading edge of the sheet S. The abutment surface 57, which serves as an abutment area, is shaped like steps having a plurality of curved surfaces. Thus, even when the leading edge of the sheet S forcefully contacts the abutment surface 57 of each of the abutment members 52, the abutment surface 57 can disperse force which will act on the sheet S, and thus reduce damage of the sheet S.

As illustrated in FIG. 4A, when the abutment members 52 are positioned at the protruding position that is a first position, at least a part of the abutment surface 57 is positioned closer to the pickup roller 26 than the separation sloping-surface portion 70. That is, at least a part of the abutment surface 57 protrudes toward the pickup roller 26 with respect to the sloping surface 21*a*. In this time, as illustrated in FIG. 3, an angle θ2 between the abutment surface 57 and the stacking surface 8*a* of the feeding tray 8 is acute on the pickup roller 26 side. Thus, when a user inserts the sheet S into the sheet feeding apparatus 13, the sheet S can reliably contact the abutment surface 57. As a result, the sheet S can be prevented from leaning on the sloping surface 21*a*, or from moving across the sloping surface 21*a* and being nipped by the conveyance roller pair 17. This can prevent failure of the feeding.

As illustrated in FIG. 4B, when the abutment members 52 are positioned at the retracting position that is a second position, the abutment surface 57 is positioned more away from the pickup roller 26 than the separation sloping-surface portion 70. That is, the abutment surface 57 does not protrude toward the pickup roller 26 from the sloping surface 21*a*. As a result, when the sheet S is fed by the pickup roller 26 and passes the separation sloping-surface portion 70, the abutment surface 57 of each of the abutment members 52 does not contact the sheet S. Thus, when the sheet S is separated from another sheet by the separation sloping-surface portion 70, the abutment members 52 do not interfere with the sheet S, and thus the sheet S can be reliably separated.

Support Structure of Pivot Shaft

FIG. 5 is an exploded perspective view of the conveyance guide 21 and the pivot shaft 52*a* as viewed from the bottom face side of the printer 10. As illustrated in FIG. 5, the conveyance guide 21 is provided with a plurality of U-shaped cutouts 21*c* whose lower portions are opened. The U-shaped cutouts 21*c* pivotably support an upper portion of the pivot shaft 52*a*. The pivot shaft 52*a* is provided with positioning ribs 52*c* extending in a radial direction. The positioning ribs 52*c* are arranged so as to hold a corresponding U-shaped cutout 21*c* therebetween, and thus the pivot shaft 52*a* is positioned in its axial direction.

Figure 6A:
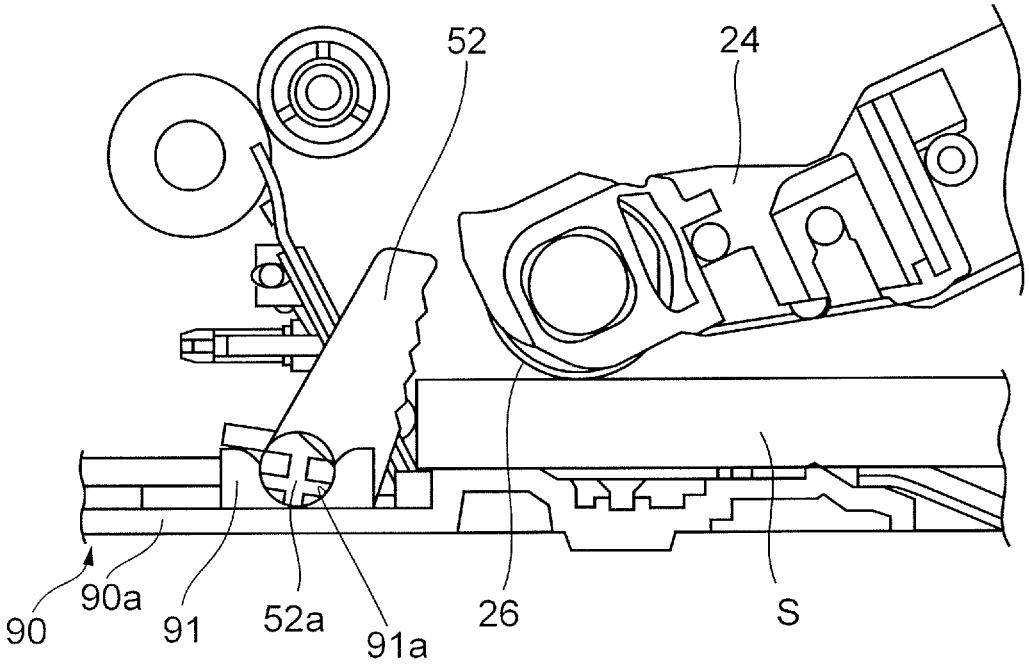
FIG. 6A is a side view illustrating a support portion which supports the pivot shaft.
Figure 6B:
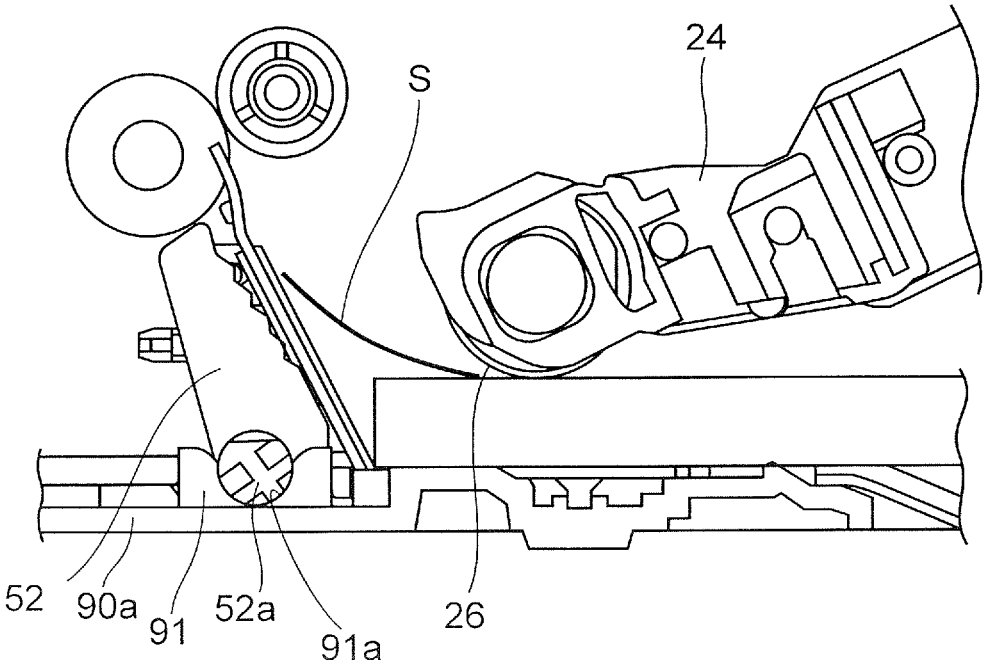
FIG. 6B is a side view illustrating the support portion which supports the pivot shaft.
Figure 7:
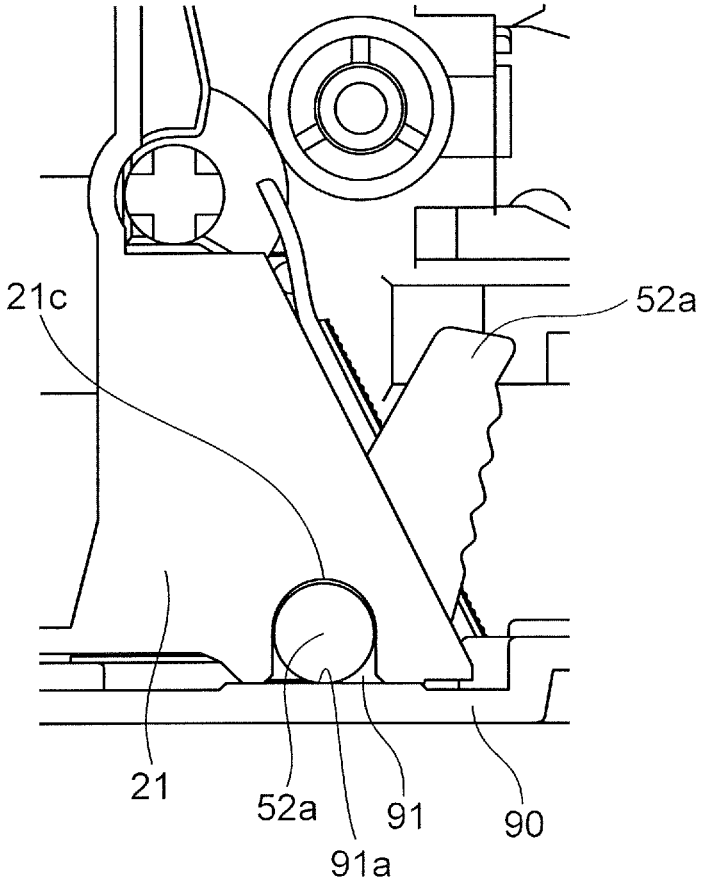
FIG. 7 is a side view illustrating U-shaped cutouts formed in the conveyance guide and in the support portion.

As illustrated in FIGS. 6A and 6B, the exterior cover 90 includes a base plate 90*a* of the sheet feeding apparatus 13 (see FIG. 1). The base plate 90*a* includes support portions 91 protruding upward. The support portions 91 have U-shaped cutouts 91*a* whose upper portions are opened. The U-shaped cutouts 91*a* pivotably support a lower portion of the pivot shaft 52*a*. That is, as illustrated in FIG. 7, the upper portion of the pivot shaft 52*a* is supported by the U-shaped cutouts 21*c* formed in the conveyance guide 21, and the lower portion of the pivot shaft 52*a* is supported by the U-shaped cutouts 91*a* formed in the support portions 91. With this structure, the pivot shaft 52*a* is positioned in a radial direction.

Figure 8:
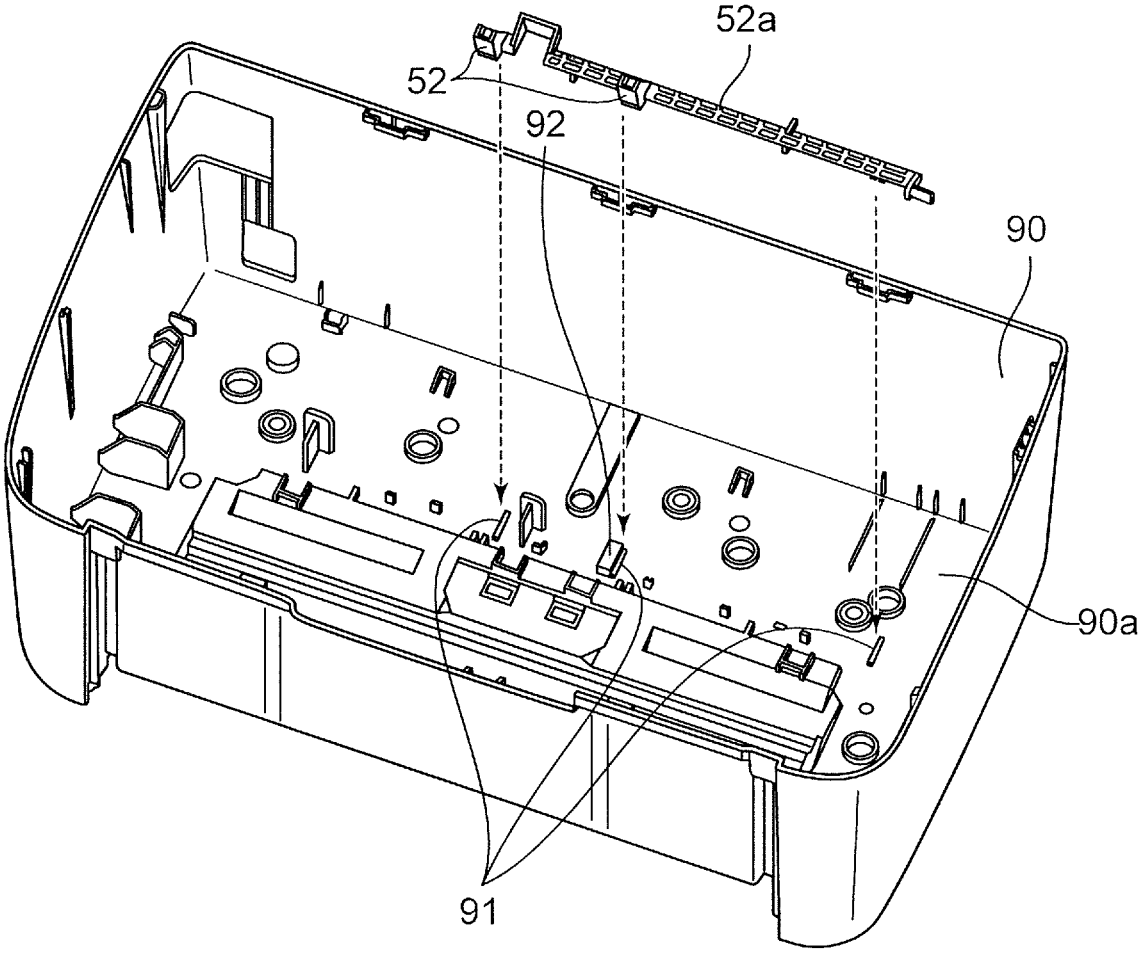
FIG. 8 is a perspective view illustrating a layout relationship between a cushioning member and the pivot shaft.

As illustrated in FIG. 8, the support portions 91 are provided in threes, and aligned with each other on the base plate 90*a*, along the axial direction of the pivot shaft 52*a*. In addition, three of the U-shaped cutouts 21*c* (see FIG. 5) formed in the conveyance guide 21 are positioned at positions corresponding to the three support portions 91. Furthermore, a cushioning member 92 is disposed, as an elastic member, on the base plate 90*a* so as to be positioned under the pivot shaft 52*a*, which is supported by the support portions 91. The cushioning member 92 is stuck on the base plate 90*a* with an adhesive tape (not illustrated); and is compressed in an outer shape of the pivot shaft 52*a*, between the base plate 90*a* and the pivot shaft 52*a* supported by the support portions 91. Thus, the cushioning member 92 does not prevent the abutment members 52 from pivoting between the protruding position and the retracting position. In the present embodiment, the cushioning member 92 is made of sponge. However, the material of the cushioning member 92 is not limited to this, and may be another material, such as rubber.

Figure 9:
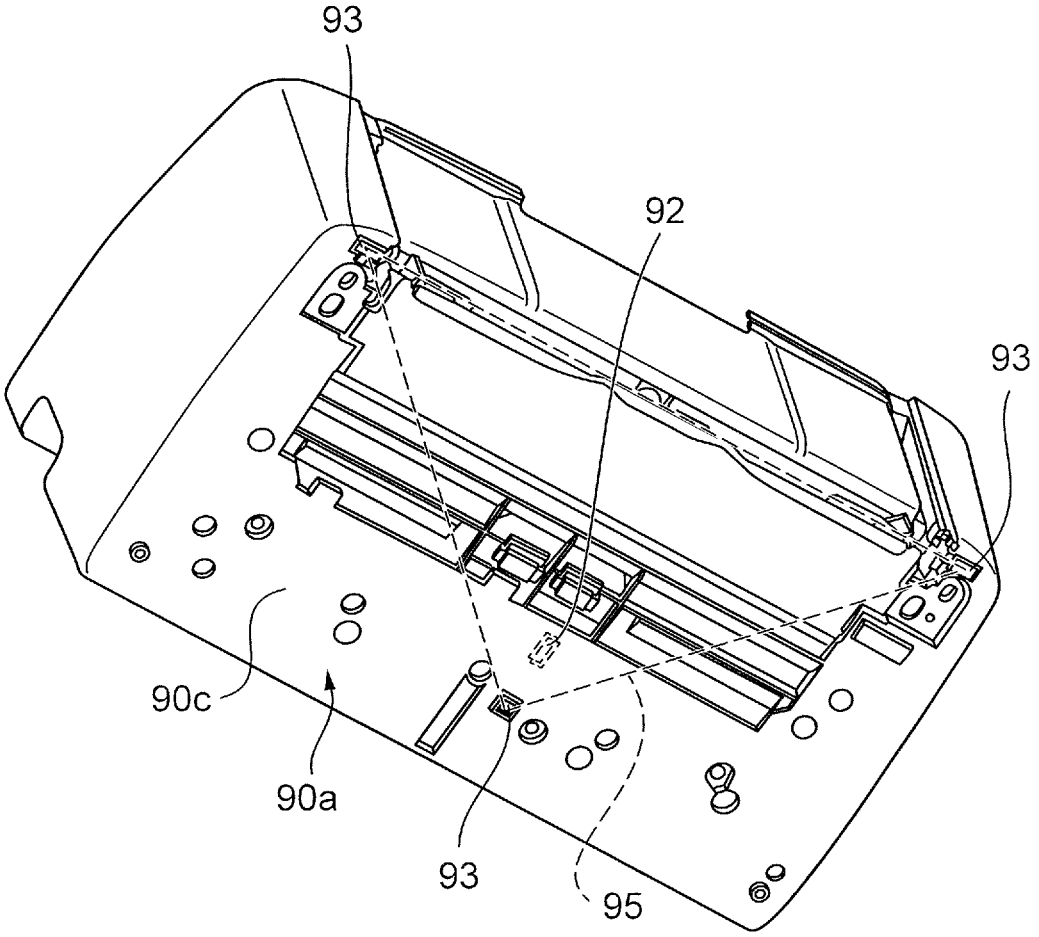
FIG. 9 is a perspective view illustrating a layout relationship between the cushioning member and foot portions.

The cushioning member 92 is disposed between the two abutment members 52 in a state where the pivot shaft 52*a* is supported by the support portions 91. In addition, the cushioning member 92 is disposed between the abutment members 52 and the base plate 90*a*, which is a part of the exterior cover 90. The arrangement of the cushioning member 92 will be more specifically described below. As illustrated in FIG. 9, a lower surface 90*c* of the base plate 90*a* is provided with foot portions 93, which are a first foot portion, a second foot portion, and a third foot portion. The foot portions 93 support the sheet feeding apparatus 13 or the printer 10.

When viewed in a direction orthogonal to the lower surface 90*c*, one foot portion 93 is not disposed on a line passing through the others. Specifically, two of the foot portions 93 are disposed on the front side of the printer 10, and one of the foot portions 93 is disposed on the back side of the printer 10. A straight line 95 which connects the foot portions 93 forms a triangle, and the cushioning member 92 is positioned inside the triangle. With the cushioning member 92 arranged in this manner, vibration of the abutment members 52 can be suppressed from propagating to the exterior cover 90. That is, the vibration can be effectively suppressed from propagating to the foot portions 93 through the base plate 90*a* of the exterior cover 90. As a result, a table or the like on which the printer 10 is placed can be prevented from vibrating and making noise.

Transmission Mechanism

Figure 10:
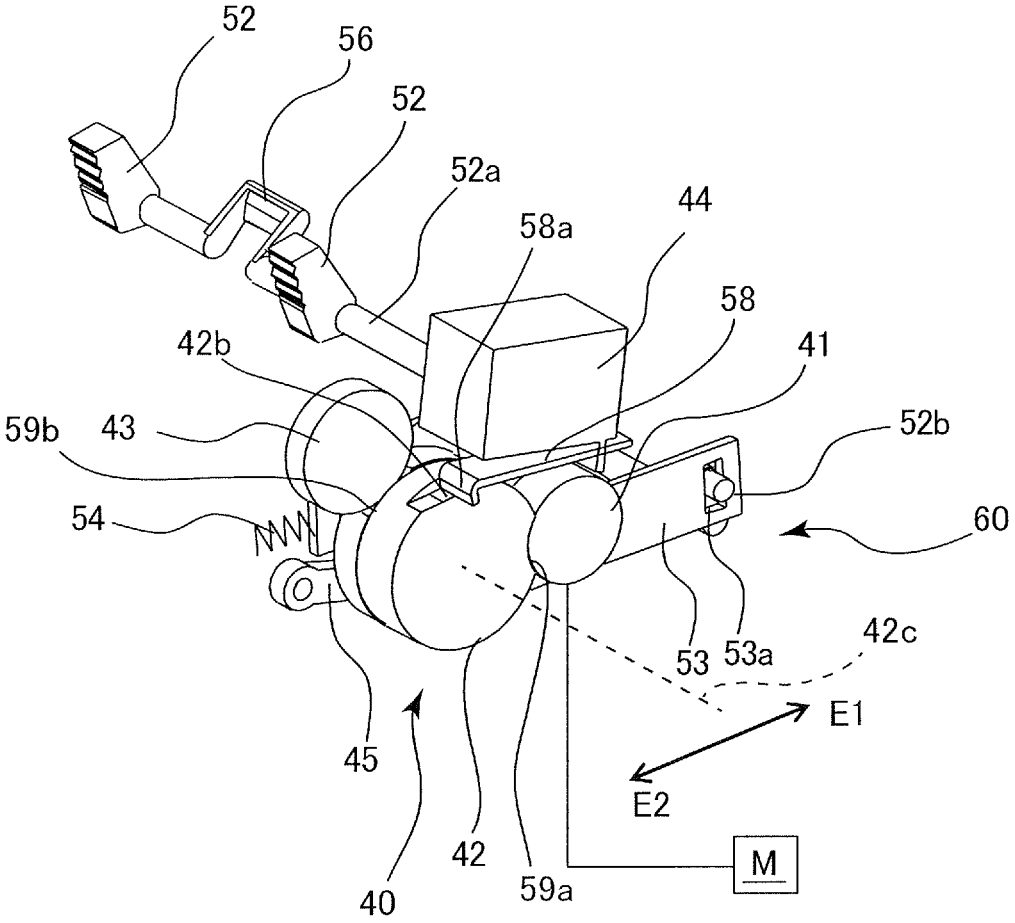
FIG. 10 is a perspective view illustrating a transmission mechanism and a moving mechanism.

Next, the transmission mechanism 40 will be described in detail with reference to FIG. 10. As illustrated in FIG. 10, the transmission mechanism 40 includes an input gear 41, a control gear 42, an output gear 43, a solenoid 44, and a locking pawl 58. The transmission mechanism 40 can transmit driving force generated by a motor M, to the pickup roller 26 (see FIG. 2).

The motor M rotates in only one direction, and generates the driving force. The input gear 41 is coupled with the motor M. The output gear 43 is fixed to the rotation shaft 25 (see FIG. 2) used to rotate the pickup roller 26. The outer circumferential surfaces of the input gear 41 and the output gear 43 are each provided with a gear teeth portion over the entire circumference. The control gear 42, which serves as a rotary member, includes a locked portion 42*b*, a first teeth-free portion 59*a*, and a second teeth-free portion 59*b*. The locked portion 42*b* is capable of locking with a pawl portion 58*a* of the locking pawl 58. The first teeth-free portion 59*a* and the second teeth-free portion 59*b* are portions of the control gear 42 in which a gear teeth portion is not formed on an outer circumferential surface thereof. The locked portion 42*b*, the first teeth-free portion 59*a*, and the second teeth-free portion 59*b* are formed along the axial direction of the control gear 42, at positions different from each other. Here, in a plane orthogonal to the axial direction and including the first teeth-free portion 59*a*, the gear teeth portion is formed on a portion of the outer circumferential surface of the control gear 42, other than the first teeth-free portion 59*a*. Similarly, in a plane orthogonal to the axial direction and including the second teeth-free portion 59*b*, the gear teeth portion is formed on a portion of the outer circumferential surface of the control gear 42, other than the second teeth-free portion 59*b*.

As illustrated in FIG. 10, when the pawl portion 58*a* of the locking pawl 58 locks the locked portion 42*b*, the control gear 42 is positioned at a rotational position (phase) which is a standby position. When the control gear 42 is positioned at the standby position, the input gear 41 faces the first teeth-free portion 59*a*, and the output gear 43 faces the second teeth-free portion 59*b*. Thus, the driving force is not transmitted between the input gear 41 and the control gear 42, and between the control gear 42 and the output gear 43.

The locking pawl 58 is urged by a spring (not illustrated) toward a direction in which the locked portion is locked. When the solenoid 44 is operated, the locking pawl 58 moves against the urging force of the spring so that the locked portion 42*b* is unlocked. That is, when the solenoid 44 is operated, the lock state between the locking pawl 58 and the locked portion 42*b* of the control gear 42 is released. The control gear 42 includes a compression spring (not illustrated). Thus, when the lock state between the locking pawl 58 and the locked portion 42*b* is released, the control gear 42 is rotated by a predetermined amount by urging force of the compression spring. With this operation, the gear teeth portion of the control gear 42 and the input gear 41 mesh with each other, and the driving force is transmitted from the input gear 41 to the control gear 42.

Moving Mechanism

Next, the moving mechanism 60 will be described in detail with reference to FIGS. 10 to 11B. As illustrated in FIGS. 10 to 11B, the moving mechanism 60 includes a link member 53. The link member 53 has an engage hole 53*a*, which can be engaged with an engage portion 52*b*. The engage portion 52*b* extends from one end of the pivot shaft 52*a*, to which the abutment members 52 are fixed; and is formed like a crank. That is, the engage portion 52*b* is shifted from the pivot shaft 52*a* in a radial direction of the pivot shaft 52*a*. The link member 53 can move toward a direction which is indicated by an arrow E1, and a direction which is indicated by an arrow E2 and opposite to the direction indicated by the arrow E1. The link member 53 is urged toward the direction indicated by the arrow E1, by a link spring 54, which serves as an urging member.

Figure 11A:
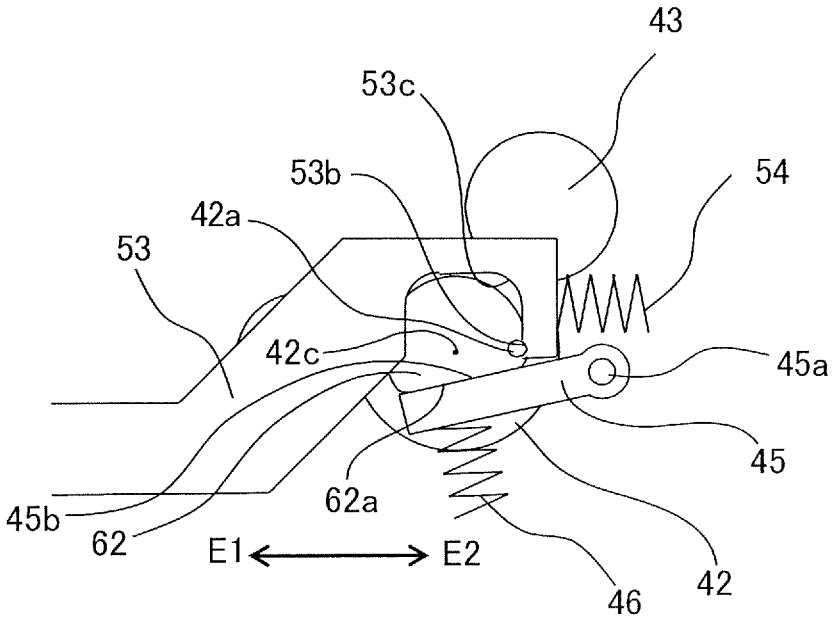
FIG. 11A is a rear view illustrating a state in which a control gear is positioned at a standby position.
Figure 11B:
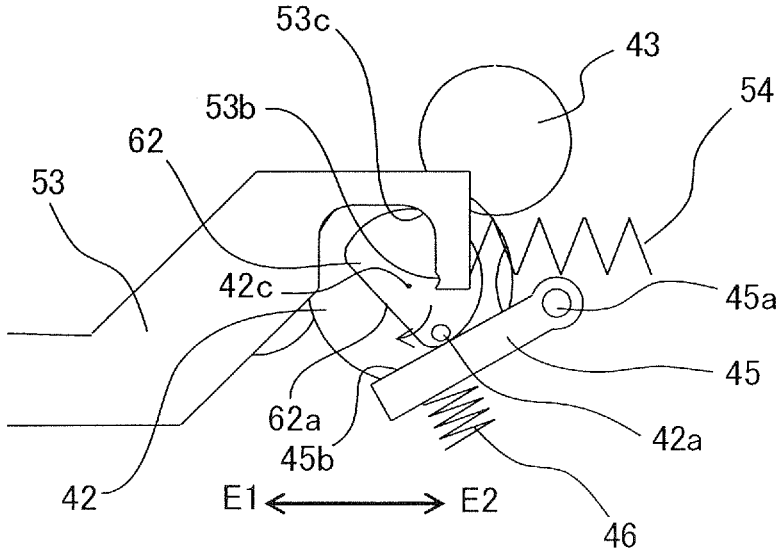
FIG. 11B is a rear view illustrating a state in which the control gear is rotated from the standby position by a predetermined amount.

As illustrated in FIG. 11A, the control gear 42 is provided with a semicircular protrusion portion 62 on a side of the control gear 42 which faces the link member 53. From the protrusion portion 62, a boss portion 42*a* extends in the axial direction of the protrusion portion 62. The boss portion 42*a* is disposed in a radial direction of the control gear 42, at a position different from a rotation axis 42*c* of the control gear 42. When the control gear 42 rotates, the boss portion 42*a* performs circular motion. In addition, a plane portion 62*a* of the protrusion portion 62 is formed so as to contact with a slide surface 45*b* of a return lever 45. The return lever 45 is supported around a pivot shaft 45*a* so that the return lever 45 can pivot on the pivot shaft 45*a*. The return lever 45 is urged by a lever spring 46 toward the plane portion 62*a*. The link member 53 includes a semicircular boss engage portion 53*b* which can engage with the boss portion 42*a*, and a cam portion 53*c* on which the boss portion 42*a* slides while pressing it. The boss portion 42*a*, which serves as a positioning portion, engages with the boss engage portion 53*b*, which serves as an engage portion; and thereby positions the abutment members 52 at the protruding position.

Feeding Operation

Next, feeding operation to feed sheets, and operations of the transmission mechanism 40 and the moving mechanism 60 will be described. The following description will be made for a case where a continuous-print job, used to continuously print an image on a plurality of sheets, is received.

As illustrated in FIG. 11A, before the continuous-print job is received, the control gear 42 is positioned at the standby position, the boss portion 42*a* is engaged with the boss engage portion 53*b*, and the slide surface 45*b* of the return lever 45 abuts against the plane portion 62*a*. In addition, the solenoid 44 is in its non-operation state, and the pawl portion 58*a* of the locking pawl 58 locks the locked portion 42*b* of the control gear 42, as illustrated in FIG. 10. With this operation, the control gear 42 is reliably held at the standby position. In this time, the first teeth-free portion 59*a* of the control gear 42 faces the input gear 41, and the second teeth-free portion 59*b* faces the output gear 43. In addition, the abutment members 52 are positioned at the protruding position, as illustrated in FIG. 4A. In the state where the abutment members 52 are positioned at the protruding position in this manner, a user inserts the sheet S from the insertion opening 81 (see FIG. 1), and abuts the leading edge of the sheet S against the abutment surface 57 of each of the abutment members 52.

When the continuous-print job is received, the controller 80 (see FIG. 1) drives the motor M in one direction, and moves the locking pawl 58 by operating the solenoid 44 for a predetermined time. Then, the lock state between the pawl portion 58*a* of the locking pawl 58 and the locked portion 42*b* of the control gear 42 is released, and the compression spring (not illustrated) included in the control gear 42 causes the control gear 42 to start rotating in one direction. When the control gear 42 rotates, the input gear 41 meshes with the gear teeth portion of the control gear 42, so that the driving force of the motor M is transmitted to the control gear 42 via the input gear 41.

As illustrated in FIG. 11B, when the control gear 42 is rotated by the driving force of the motor M, the boss portion

42*a* formed on the control gear 42 is separated from the boss engage portion 53*b* of the link member 53, and the engagement between the boss portion 42*a* and the boss engage portion 53*b* is released. In addition, the protrusion portion 62 presses the slide surface 45*b* of the return lever 45, pivoting the return lever 45 against the urging force of the lever spring 46. Then, the urging force of the link spring 54 moves the link member 53 toward the direction indicated by the arrow E1. As illustrated in FIG. 10, when the engage hole 53*a* engaged with the engage portion 52*b* moves in the direction indicated by the arrow E1, the pivot shaft 52*a* rotates. With this operation, the abutment members 52 fixed to the pivot shaft 52*a* move from the protruding position to the retracting position. The link member 53 moves relatively faster, when the engagement between the boss portion 42*a* and the boss engage portion 53*b* is released, because of the urging force of the link spring 54. Thus, the abutment members 52 move relatively faster from the protruding position to the retracting position. Specifically, the abutment members 52 move from the protruding position to the retracting position in tens of milliseconds.

After the abutment members 52 move to the retracting position, the output gear 43 starts to mesh with the gear teeth portion of the control gear 42. That is, since the second teeth-free portion 59*b* of the control gear 42 is formed in a wider range than the first teeth-free portion 59*a*, the output gear 43 remains facing the second teeth-free portion 59*b* until the control gear 42 rotates by a predetermined angle from the standby position. Thus, the sheet S is not fed by the pickup roller 26 until the abutment members 52 move to the retracting position.

When the output gear 43 is rotated by the control gear 42, the pickup roller 26 rotates and feeds the sheet S from the stacking surface 8*a*. The boss portion 42*a*, formed on the control gear 42, slidingly contacts the cam portion 53*c* of the link member 53 before the control gear 42 completes its one rotation performed from the standby position. Since the boss portion 42*a* presses the cam portion 53*c* while slidingly contacting the cam portion 53*c*, the link member 53 is moved, as illustrated in FIG. 11A, toward a direction indicated by an arrow E2 against the urging force of the link spring 54. When the link member 53 is moved, in this manner, toward the direction indicated by the arrow E2, the abutment members 52 gradually move from the retracting position toward the protruding position. After that, when the control gear 42 is positioned at the standby position, the boss portion 42*a* engages with the boss engage portion 53*b*, and the abutment members 52 are positioned at the protruding position again. In the state where the boss portion 42*a* and the boss engage portion 53*b* are engaged with each other, the slide surface 45*b* of the return lever 45 presses the plane portion 62*a* of the protrusion portion 62 toward the rotation axis 42*c* of the control gear 42, in response to the urging force of the lever spring 46. In addition, the boss engage portion 53*b* also presses the boss portion 42*a* toward the rotation axis 42*c* of the control gear 42, in response to the urging force of the link spring 54. The urging direction of the lever spring 46 and the urging direction of the link spring 54 are substantially orthogonal to each other. Thus, the boss portion 42*a* can stably retain the engagement state between the boss portion 42*a* and the boss engage portion 53*b*.

The stop control for the control gear 42 for each one rotation, that is, the one-rotation control for the control gear 42 is performed as described above. Thus, while the control gear 42 makes one rotation, the sheet S is moved at least until the leading edge of the sheet S is nipped by the conveyance roller pair 17. The sheet S nipped by the conveyance roller pair 17 is conveyed downstream in the sheet conveyance direction, by the conveyance roller pair 17. In this time, the pickup roller 26 is in contact with the sheet S which is being conveyed, and thus is rotated by the sheet S. However, in the state where the control gear 42 is positioned at the standby position, since the second teeth-free portion 59*b* of the control gear 42 and the output gear 43 face each other, the rotation of the output gear 43 is not transmitted to the control gear 42. Thus, teeth jumping and damage of gears can be prevented.

In the continuous-print job, the motor M is rotated until the job is completed, and the solenoid 44 is operated at a timing when each sheet S is fed. With this operation, every time each sheet is fed, the boss portion 42*a* performs a series of operations; that is, the boss portion 42*a* is released from the engagement with the boss engage portion 53*b*, presses the cam portion 53*c*, and engages with the boss engage portion 53*b* again. Thus, before the sheet S reaches the abutment members 52, the abutment members 52 move from the protruding position to the retracting position.

In addition, while the sheet S is passing the abutment members 52, the abutment members 52 are moved from the retracting position to the protruding position by the link member 53 which is being pressed by the boss portion 42*a* along the cam portion 53*c*. In this time, the abutment members 52 move slower than when moving from the protruding position to the retracting position. That is, when the abutment members 52 move from the protruding position to the retracting position, the link member 53 moves relatively faster toward the direction indicated by the arrow E1, because of the urging force of the link spring 54; whereas, when the abutment members 52 move from the retracting position to the protruding position, the link member 53 is slowly pressed toward the direction indicated by the arrow E2, by the boss portion 42*a*, along the cam portion 53*c* at a speed slower than a speed at which the link member 53 is moved by the urging force of the link spring 54.

With this configuration, when the abutment members 52 move from the retracting position to the protruding position, vibration of the sheet S caused by the abutment members 52 can be reduced, and this leads to reduction of defective image. In addition, since the abutment members 52 move from the retracting position to the protruding position while the sheet S is passing the abutment members 52, intervals at which the sheet S is conveyed can be reduced, and the productivity can be increased. Furthermore, the control gear 42 can be downsized.

In addition, since the abutment members 52 return to the protruding position every time each sheet S is fed, the sheet S can be prevented from leaning on the separation sloping-surface portion 70 during a job, and this leads to reduction in failure of the feeding. Furthermore, even though the motor M rotates in only one direction, the abutment members 52 can be moved between the protruding position and the retracting position by the simple mechanical configuration, in synchronization with the feeding of the sheet S. This can achieve cost reduction and downsizing.

In the present embodiment, the one-rotation control for the control gear 42 is achieved by using the solenoid 44, the first teeth-free portion 59*a*, and the second teeth-free portion 59*b*. The present disclosure, however, is not limited to this configuration. For example, the first teeth-free portion 59*a* of the control gear 42 may not be formed, the input gear 41 may always mesh with the control gear 42, and a torque limiter may be provided between the input gear 41 and the rotation shaft of the input gear 41. As another example, the one-rotation control for the control gear 42 may be performed by using an electromagnetic clutch or another clutch mechanism. In addition, each sheet may be fed while the control gear 42 makes not one rotation, but two or more rotations.

The feeding tray 8 may be provided with an intermediate plate which can move up and down, and the sheet intermediate plate may move up and down in response to the one-rotation control for the control gear 42. The rotation shaft 25 may be provided with a cam, and the sheet supporting portion may be provided with a cam follower which can engage with the cam. The holder 24, which raises and lowers the pickup roller 26, may swing for each sheet.

The present embodiment has been described for the electrophotographic printer 10, but the present invention is not limited to this. For example, the present invention may be applied to other image forming apparatuses, such as electrophotographic full-color printers, copying machines, facsimiles, and multifunction products. In addition, the present invention may also be applied to ink-jet image forming apparatuses that form images on sheets by injecting ink from their nozzles. In the present embodiment, the sheet feeding apparatus 13 is disposed in the printer 10. The present disclosure, however, is not limited to this. For example, the sheet feeding apparatus of the present embodiment may be applied to an option feeder which is connected to a bottom face or a side face of the printer 10.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-159736, filed Aug. 22, 2017, Japanese Patent Application No. 2017-159735, filed Aug. 22, 2017, and Japanese Patent Application No. 2017-230515, filed Nov. 30, 2017, which are hereby incorporated by reference herein in their entirety.

What is claimed is:

1. A sheet feeding apparatus comprising:

a stacking part on which a sheet is stacked;

a feeding part configured to feed the sheet stacked on the stacking part;

a separation part configured to separate the sheet from another sheet while slidingly contacting the sheet fed by the feeding part;

an abutment part comprising an abutment area against which a leading edge of the sheet stacked on the stacking part abuts, the abutment part being configured to move between a first position and a second position, the first position being a position at which at least a part of the abutment area protrudes from the separation part toward the feeding part, the second position being a position at which the abutment area does not protrude from the separation part toward the feeding part;

a transmission part comprising a rotary member and configured to transmit driving power from a driving source to the feeding part via the rotary member, the rotary member being configured to be stopped every one rotation; and a moving part configured to move the abutment part in response to rotation of the rotary member such that (1) the abutment part positions at the first position in a case where the rotary member is stopped, and (2) the abutment part moves from the first position to the second position and from the second position to the first position while the rotary member makes one rotation, wherein the feeding part feeds one sheet stacked on the stacking part in response to one rotation of the rotary member, wherein the abutment part moves from the first position to the second position before the sheet fed by the feeding part reaches the abutment part, and moves from the second position to the first position while the sheet is passing the abutment part, wherein the moving part comprises:

a positioning portion provided on the rotary member;

a link member comprising an engaged portion configured to engage with the positioning portion, the link member being joined with the abutment part; and an urging member configured to urge the link member such that the abutment part moves toward the second position, and wherein the abutment part is retained at the first position against an urging force of the urging member in a case where the positioning portion is engaged with the engage portion of the link member.

2. The sheet feeding apparatus according to claim 1, wherein a time required for moving the abutment part from the second position to the first position is longer than a time required for moving the abutment part from the first position to the second position.

3. The sheet feeding apparatus according to claim 1, wherein the positioning portion is engaged with the engaged portion in a case where the rotary member is stopped.

4. The sheet feeding apparatus according to claim 1, wherein the positioning portion is disposed at a position different from a rotation axis of the rotary member in a radial direction of the rotary member.

5. The sheet feeding apparatus according to claim 1, wherein the link member comprises a cam portion configured to be pressed by the positioning portion, and wherein the positioning portion is released from the engaged portion, presses the cam portion, and engages with the engaged portion while the rotary member makes one rotation.

6. The sheet feeding apparatus according to claim 5, wherein the link member is moved by the urging force of the urging member so as to move the abutment part toward the second position in a case where an engagement between the positioning portion and the engaged portion is released, wherein the link member moves the abutment part from the second position toward the first position in a case where the cam portion is pressed by the positioning portion against the urging force of the urging member, and wherein the positioning portion moves the link member by pressing the cam portion of the link member at a speed slower than a speed at which the link member is moved by the urging force of the urging member.

7. The sheet feeding apparatus according to claim 1, further comprising:

a guide part comprising the separation part and an opening part, the opening part being configured to accommodate the abutment part positioned at the second position; and a separation member comprising a plurality of convexities and concavities formed along the separation part.

8. The sheet feeding apparatus according to claim 1, wherein the stacking part comprises a support surface configured to support the sheet, wherein the separation part comprises a separation surface configured to contact the sheet, wherein an angle defined by the support surface and the separation surface is obtuse on a feeding part side, and wherein an angle defined by the support surface and the abutment area of the abutment part positioned at the first position is acute on the feeding part side.

9. The sheet feeding apparatus according to claim 1, further comprising a motor serving as the driving source and configured to rotate in only one direction.

10. The sheet feeding apparatus according to claim 1, further comprising:

an exterior member configured to constitutes an exterior of the sheet feeding apparatus; and an elastic member disposed between the abutment part and the exterior member, and configured to elastically deform.

11. The sheet feeding apparatus according to claim 10, wherein the abutment part is one of a plurality of abutment parts, wherein the sheet feeding apparatus further comprises a shaft member configured to pivotally support the plurality of abutment parts, wherein the exterior member comprises a base plate of the sheet feeding apparatus, and wherein the elastic member is disposed between the shaft member and the base plate.

12. The sheet feeding apparatus according to claim 11, wherein the base plate comprises a support portion configured to pivotally support the shaft member, and wherein the elastic member is compressed between the shaft member supported by the support portion and the base plate.

13. The sheet feeding apparatus according to claim 11, wherein the sheet feeding apparatus further comprises a first foot portion, a second foot portion, and a third foot portion each provided on a bottom surface of the base plate and configured to support the sheet feeding apparatus, wherein the third foot portion is not disposed on a line passing through the first foot portion and the second foot portion, when viewed in an orthogonal direction which is orthogonal to the bottom surface, and wherein the elastic member is disposed inside a triangle, when viewed in the orthogonal direction, defined by connecting the first foot portion, the second foot portion, and the third foot portion.

14. The sheet feeding apparatus according to claim 10, wherein the elastic member is made of sponge.

15. An image forming apparatus comprising:

the sheet feeding apparatus according to claim 1; and an image forming part configured to form an image on the sheet fed by the sheet feeding apparatus.

16. A sheet feeding apparatus comprising:

a stacking part comprising a stacking surface on which a sheet is stacked;

a feeding part configured to feed the sheet stacked on the stacking surface;

a separation part comprising a slope member configured to be inclined with respect to the stacking surface and configured to abut against the sheet fed by the feeding part, the separation part being configured to separate the sheet from another sheet;

an abutment part comprising a pivot shaft around which the abutment part pivots, an abutment area against which a leading edge of the sheet stacked on the stacking surface abuts, and an engage part shifted from the pivot shaft in a radial direction of the pivot shaft and configured to pivot with the pivot shaft, the abutment part being configured to move between a first position and a second position, the first position being a position at which at least a part of the abutment area protrudes from the slope member toward the feeding part, the second position being a position at which the abutment area does not protrude from the slope member toward the feeding part;

a transmission part comprising a rotary member and configured to transmit driving power from a driving source to the feeding part via the rotary member, the rotary member being configured to be stopped every one rotation;

a link member comprising an engaged portion engaged with the engage part, the link member being configured to reciprocate in a first direction and a second direction opposite to the first direction so that the engage portion pivots around the pivot shaft; and an urging member configured to urge the link member in the first direction, the abutment part moving from the first position to the second position in a case where the link member moves in the first direction by an urging force of the urging member, wherein the link member is configured to engage with the rotary member, with an engagement between the link member and the rotary member being released by rotation of the rotary member.

* * * * *